United States Patent [19]

Martin et al.

[11] 4,035,611

[45] July 12, 1977

[54] APPARATUS FOR ELECTRICALLY PERFORATING MOVING PAPER WEBS

[75] Inventors: Richard Hugo Martin; William F. Owens, Jr., both of Pisgah Forest, N.C.

[73] Assignee: Olin Corporation, Pisgah Forest, N.C.

[21] Appl. No.: 691,624

[22] Filed: June 1, 1976

[51] Int. Cl.[2] ..... H05B 7/18

[52] U.S. Cl. ..... 219/384; 131/15 B

[58] Field of Search ..... 219/121 EB, 383, 384; 83/16, 171; 131/15 B; 93/1 R; 264/154, 156; 346/74, 74 SB

[56] References Cited

U.S. PATENT DOCUMENTS

| | | | |
|---|---|---|---|
| 3,017,486 | 1/1962 | Kogan et al. | 219/383 |
| 3,167,641 | 1/1965 | Parmele et al. | 219/384 |
| 3,198,934 | 8/1965 | Dubilier | 219/384 |
| 3,348,022 | 10/1967 | Schirmer | 219/384 |
| 3,475,591 | 10/1969 | Fujii et al. | 219/384 |
| 3,545,208 | 3/1951 | Meaker | 219/384 |
| 3,549,943 | 12/1970 | Church | 219/383 |
| 3,783,237 | 1/1974 | McArthur | 219/384 |
| 3,996,143 | 7/1963 | Warmt | 219/384 |

*Primary Examiner*—Volodymyr Y. Mayewsky
*Attorney, Agent, or Firm*—Robert W. Habel

[57] ABSTRACT

Method and apparatus for electrically perforating a moving web such as paper, film and the like in which the web passes between spaced, charged and ground electrodes adapted to move at right angles to one another, including a flat plate for supporting said web as it passes between said spaced electrodes having a narrow slot in which the ground electrode travels parallel to the surface of said plate, said surface recessed along both sides of said slot to provide a collection area for particulate matter produced from perforating said web and means for removing said particulate matter from said collection area.

7 Claims, 9 Drawing Figures

APPARATUS FOR ELECTRICALLY PERFORATING MOVING PAPER WEBS

BACKGROUND OF THE INVENTION

1. Field of the Invention

This invention relates generally to apparatus for perforating moving webs of paper, film and like materials by intermittent or pulsed electric discharge and more particularly to apparatus for perforating cigarette paper in which the web of paper is drawn through the gap between electrically charged electrode means and ground electrode means whereby the web is perforated by intermittent arcing between electrodes as it passes between them.

2. Description of the Prior Art

Numerous devices have been developed for making perforations in paper and related web materials by pulsed electrical discharge. Typically, such devices utilize various types of pin or needle arrangements for the discharge electrodes in combination with a stationary or rotating member as the ground electrode, as shown in U.S. Pat. Nos. 3,098,143; 3,348,022; 3,385,951; 3,475,591; 3,760,153; 3,783,237; and 3,862,396. All of these devices suffer from the drawback that the discharge electrode pins tend to degrade rapidly by thermal erosion from the high heat generated during arcing between the pins and the ground electrode. Such degradation changes the gap between the electrodes and corrodes and insulates the point of the pin electrodes causing the pins to misfire resulting in nonuniform perforation of the web material.

Other types of electrodes have been employed such as spaced pairs of oppositely placed rotating wheels or discs between which the web material is passed, as disclosed in U.S. Pat. Nos. 2,372,508 and 3,167,641. While these devices have the advantage of periodically presenting a different surface for spark discharge, thereby reducing thermal erosion, they have the disadvantage of producing perforations in the sheet material of uneven size because the arcing point between electrodes cannot be precisely localized.

A method and apparatus that overcomes the disadvantages of the above prior art devices is disclosed in the application of Richard Hugo Martin, Ser. No. 654,201, filed Feb. 2, 1976, assigned to the same assignee as the assignee of the present application. However, one problem that has been encountered with the apparatus of said copending application is collection and removal of particulate matter produced during the perforating operation when the web to be perforated is paper, such as cigarette paper. The residue from the holes produced in the web builds up near the ground electrode and other areas under the web, requiring periodic shutdown of the apparatus for cleanup. Such residue is primarily calcium carbonate filler from the paper and the configuration of the grounding plate has not proved satisfactory for long-term operation of the electrostatic perforater because the particles build up on the plate causing the paper web to break, thereby reducing productivity.

SUMMARY OF THE PRESENT INVENTION

Accordingly, it is an object of this invention to provide a method and apparatus for electrically perforating moving webs such as paper, cigarette paper and the like that does not possess the disadvantages inherent in the prior art devices. More specifically, it is an object of this invention to provide a method and electrical perforating apparatus in which the arcing point between discharge and ground electrodes is narrowly and precisely defined, the problem of thermal degradation of said electrodes is minimized, particulate matter produced during perforating is efficiently removed and web breakage during perforating is reduced. Still another object of this invention is to provide apparatus and a method for electrically perforating moving webs such as paper, cigarette paper and the like that will perforate minute, evenly spaced holes in the web of uniform size without requiring periodic shutdown of the apparatus for removal of particulate matter.

These and other objects of the invention are accomplished by apparatus for perforating a moving web comprising a perforating unit having charged electrode means adapted to rotate in a direction parallel to the direction of the moving web, connected to an intermittent high voltage source, a ground electrode spaced from said charged electrode means adapted to move at right angles to the direction of rotation of the charged electrode means, and means for drawing a web of material between said charged electrode means and said ground electrode whereby intermittent arcing between them perforates the web material. In one embodiment the ground electrode is a thin endless band or ribbon disposed with one edge in spaced relationship to the rotating charged electrode means to provide a gap through which the web material is drawn. Alternately, the ground electrode may be a narrow wire arranged in an endless loop or drawn continuously from a supply source. Preferably, the charged electrode means comprises a plurality of rotatable discs of equal dimension aligned axially in spaced relationship. The web passes over a flat plate having an insulated surface provided with a narrow slot in which the ground electrode travels. Such electrode is grounded through brushes or other conventional means and the surface on which the sheet travels is insulated from ground to confine arcing solely between the peripheral edges of the charged electrodes and the ground electrode, thereby constantly providing new discharge surfaces on both the charged and ground electrodes for the spark periodically occurring between them. In accordance with this invention, the surface of the flat plate adjacent the slot is recessed to provide an area in which particulate matter produced during perforating collects and is removed via openings in the bottom of the recess. Thus, because the plate is recessed adjacent to the slot, the paper web does not contact the plate surface in the immediate vicinity of the moving ground electrode and no buildup of residue occurs because it is continuously collected and removed.

Each discharge electrode is separately connected to an intermittent high voltage source such as a high voltage pulse generator which produces a high voltage potential at preselected intervals. Thus, in the preferred embodiment, with each pulse of the generator an arc occurs between the edge of each rotating disc electrode and the edge of the moving band ground electrode, thereby producing the perforations in the web of sheet material passing between said electrodes. Since only the edges of the opposing electrodes are in close proximity and pass at right angles to each other at the instant of each high voltage pulse, the spark or arc that occurs is precisely and narrowly confined so that multiple arcing through the same perforation is prevented. Also, the combination of rotating disc electrodes with a moving band ground electrode provides a constantly renewable surface on both electrodes at the point at which arcing occurs, thereby minimizing thermal erosion of either electrode surface and because the surface of the flat plate is provided with a recess adjacent the slot, particles can be continuously and efficiently collected and removed without stopping the perforating operation.

BRIEF DESCRIPTION OF THE DRAWINGS

In order that the invention may be more readily understood and carried into effect, reference is made to the accompanying drawings and the description thereof which are offered by way of illustration only and not in limitation of the invention, the scope of which is defined by the appended claims rather than any description preceding them.

In the drawings.

DETAILS OF THE INVENTION

Figure 1:
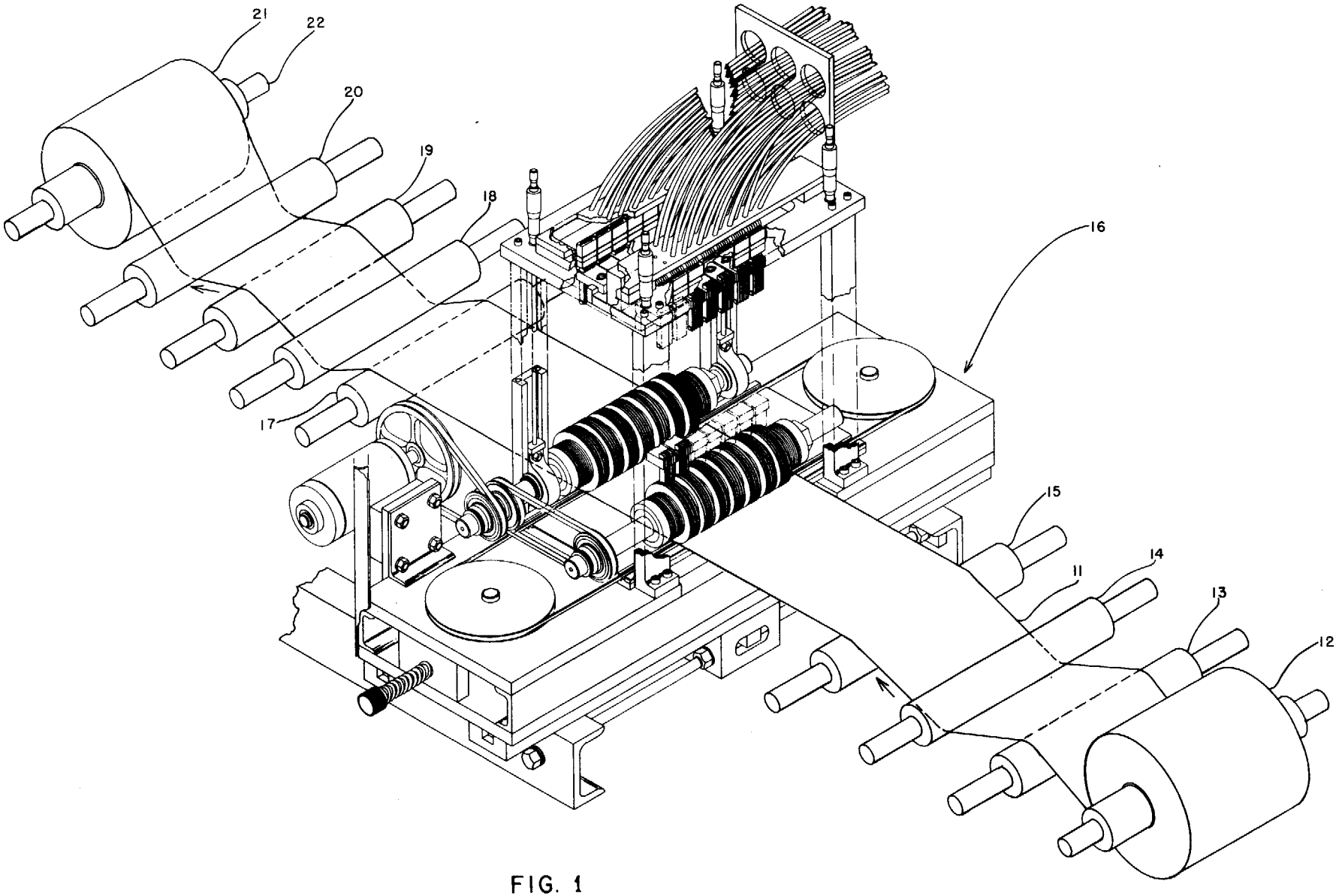
FIG. 1 is a perspective view of the overall apparatus embodying the invention with certain parts broken away and others exploded for purposes of clarity.

Referring to FIG. 1 showing the overall apparatus, a web of paper is drawn from a feed roll 12 over idle rollers 13, 14 and 15, through the perforating assembly, generally designated 16, then over idle rollers 17, 18, 19 and 20, and finally to take-up roll 21. Power for drawing the web 11 from feed to take-up is supplied by a conventional drive means, not shown, connected to shaft 22 of the take-up roll 21.

Figure 2:
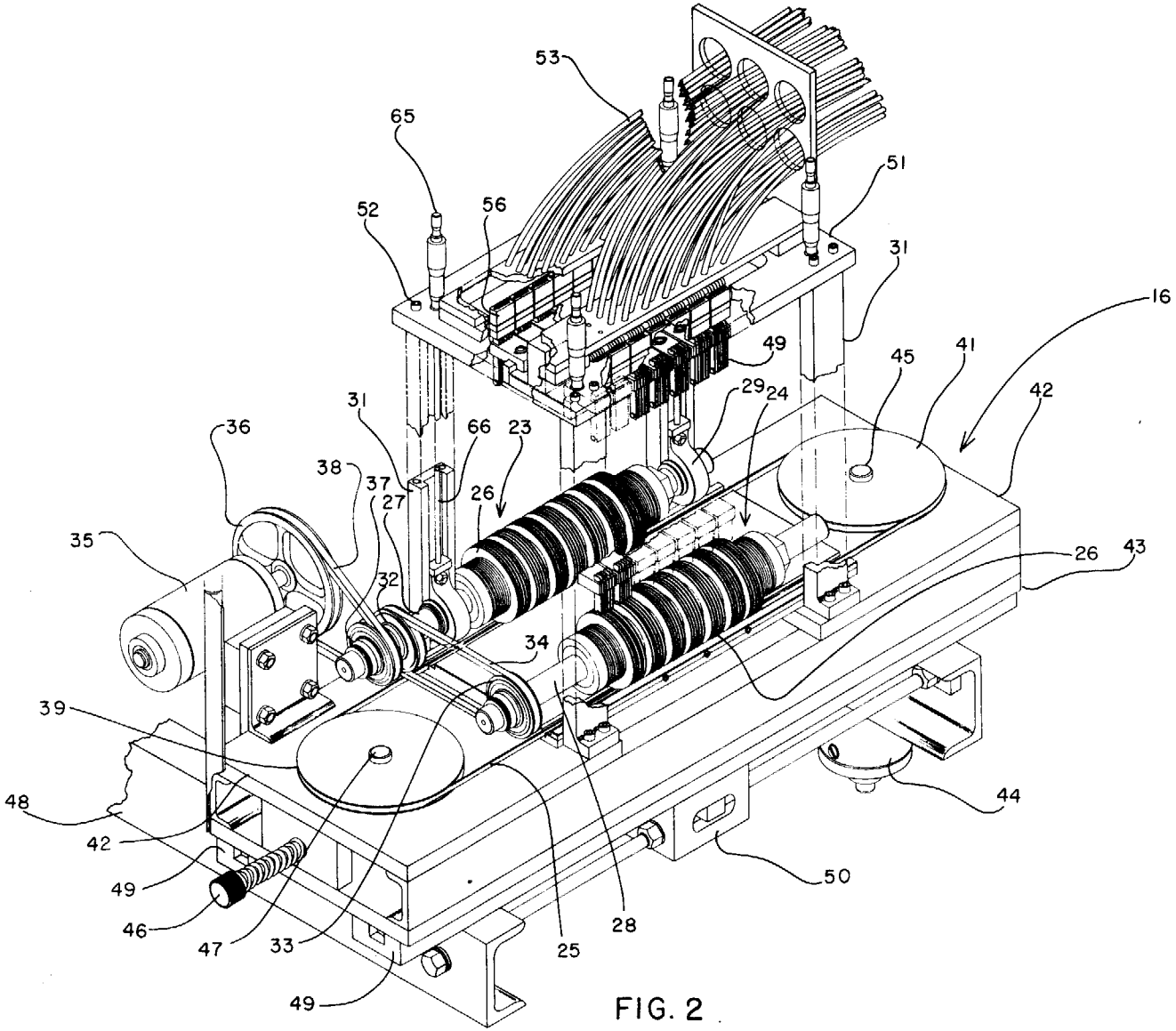
FIG. 2 is an enlarged perspective view of the perforating assembly with the brush assembly exploded away from the disc electrodes to more clearly show the details of the apparatus.

In the enlarged view of the perforator assembly 16 shown in FIG. 2, the web to be perforated passes through the gap formed by two charged rotating disc assemblies generally designated 23 and 24 and the two segments of endless band ground electrode 25. In the embodiment shown, each disc assembly 23 and 24 is comprised of a series of individually charged discs 26 arranged in groups of six on shafts 27 and 38 held at opposite ends by bearing blocks 29 slidably mounted on uprights 31. Pulleys 32 and 33 are journaled on shafts 27 and 28 respectively, and interconnected by belt 34. Both disc assemblies are driven by common drive motor 35 via pulleys 36 and 37 through drive belt 38. Typically driving speeds may range from 25 to 50 RPM and disc rotation can be either in the direction of web movement or counter to the direction of web movement, although the former is preferred. The ground electrode 25 is an endless steel band positioned to pass around sheaves 39 and 41, both of which are rotatably mounted on plates 42 at opposite ends of the perforator assembly base 43 and driven by motor 44 via a conventional drive mechanism, not shown, connected on one end of mandrel 45. Illustratively, the endless band is driven at .5 to 1 RPM and can be driven in either direction. Tension adjustment of the grounded band electrode 25 is provided by knurled screw 46 fixed at its opposite end to the bearing block, not shown, in which mandrel 47 of sheave 39 rotates, said bearing block and mandrel being movably mounted in transverse guide slots in plate 42. The perforator assembly is mounted on a support frame 48. Guide bars 49 under base 43 engage cooperating elements on frame 48 for lateral movement of the perforator assembly to facilitate positioning of the electrode assembly relative to the web. Lateral adjustment is accomplished by adjusting mechanism 50.

Figure 4:
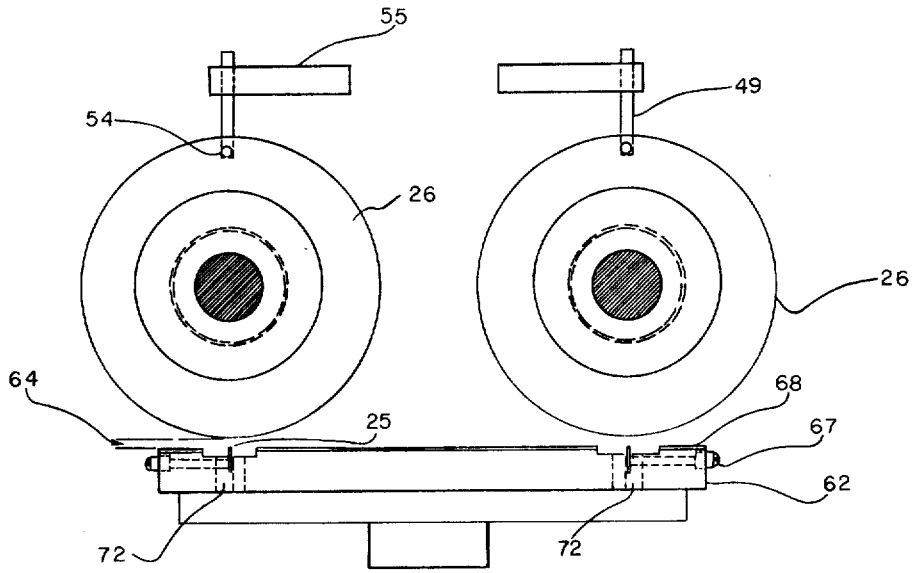
FIG. 4 is an end view in section of the perforating assembly taken along line 4—4 of FIG. 3.

A multiplicity of brushes 49 are provided to individually power each disc electrode, as shown in greater detail in FIG. 4. The brushes are assembled in sets corresponding to the groups of disc electrodes and mounted on a support made from a suitable electrical insulating material such as commercial dielectric board attached to the underside of plate 51 which is fixed to uprights 31 by screws 52. All brushes are electrically insulated from each other and the frame. Separate lead wires 53 electrically connect each brush individually with the intermittent high voltage power source. As shown more clearly in FIG. 4, each brush 49 has a contact point 54 engaging a disc electrode. The contact points 54 preferably are a silver-graphite alloy fused on a brush made of copper/beryllium spring alloy. Each brush is fixedly mounted on brush blocks 55 made from a resin laminated sheet to provide electrical insulation, and blocks 55 are in turn mounted on support attached to plate 51. The spring tension of the brushes provides positive contact between contact points 54 and the peripheral sides of discs 26. Lead wires 53 are connected to each of the individual brushes in sets by corresponding sets of pin connectors 56. In this manner, a unit assembly of brushes such as the sets of six shown in the drawings can be conveniently removed and replaced.

Figure 3:
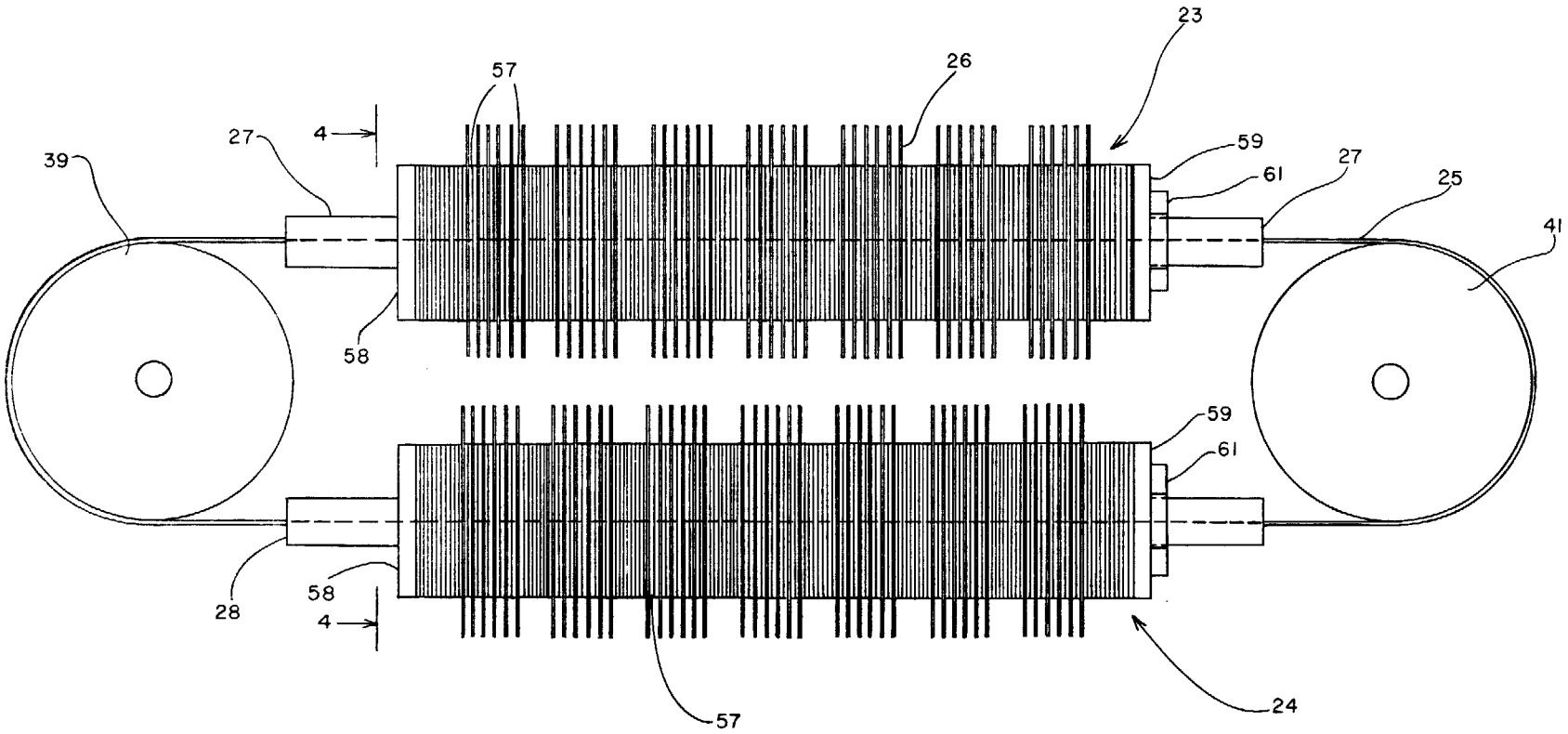
FIG. 3 is a top view in elevation showing the relationship of the dual assemblies of disc electrodes to each other and to the grounded band electrode.
Figure 5:
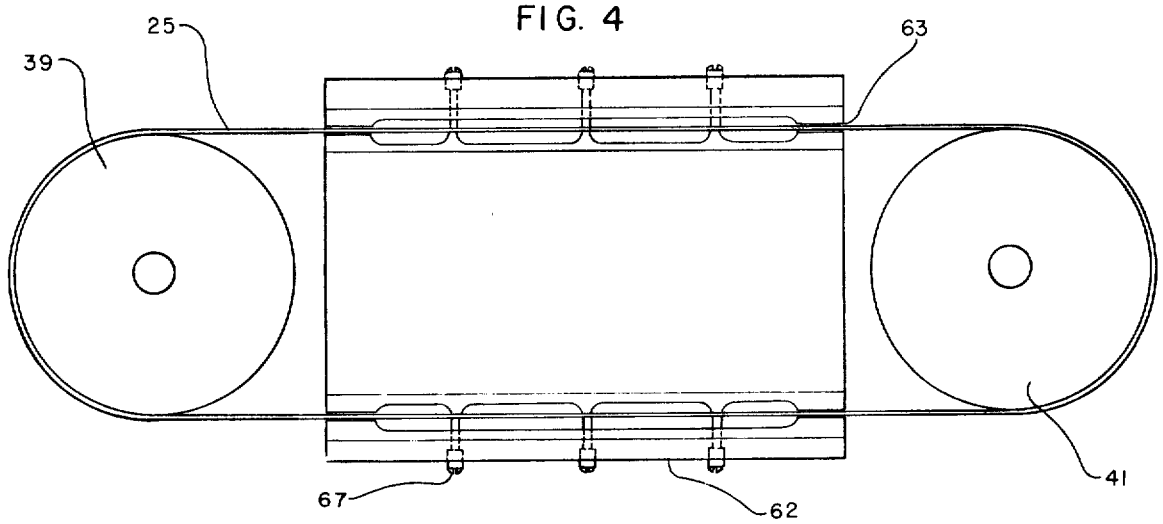
FIG. 5 is a top view of the grounded band electrode and insulated flat plate over which the moving web passes during perforation.

Details of the rotating disc electrode assemblies 23 and 24 and band electrode 25 are shown more clearly in FIGS. 3, 4 and 5. On each disc assembly the discs 26 are spaced from one another by insulating spacers 57. Each of shafts 27 and 28 has a fixed endplate 58, integral with the shaft. One end of a ceramic sleeve, not shown, equal in length to the discs and spacers, slides on each shaft 27 and 28 to abut against endplate 58, where it is glued or otherwise affixed in place to provide electrical insulation between the discs and shafts. Spacers 57 and discs 26 are arranged aternately in any desired position over the ceramic sleeve with additional spacers provided between sets of discs at each end of the assembly. Collar 59 and locknut 61 are conventionally employed to hold the assembly of discs and spacers securely on the shafts. The disc electrodes preferably are constructed from tungsten sheet or Swedish knife steel sheet and then chrome plated, although other strong electrically conductive metals such as stainless steel can be used. All discs are identical in size and preferably have knife-like rims. The insulating spacers 57 may be made from a synthetic polymer resin or the resin-fiberglass mat sheets commonly used in the electroincs industry in the construction of circuit boards. Thus, the discs are insulated from each other by the spacers and from the shaft by the ceramic sleeve.

The spacial configuration of the electrode disc assemblies and grounded band electrode is also illustrated in FIGS. 3, 4 and 5. Each disc assembly is suspended above the top flat surface of rounding plate 62 with the axis of shafts 27 and 28 parallel to the axis of the moving band electrode. The disc electrodes are oriented in such manner that the shaft axis (or imaginary lne described by the disc centers) lies directly above and in line with the band electrode slot guides 63 in grounding plate 62. In addition, disc assembly 23 is oriented relative to disc assembly 24 such that the rims of individual discs of one assembly are located at the midpoint between the rims of discs on the other assembly. In this manner, different areas of the web are exposed for perforating between the band electrode and disc assembly 23 relative to the band electrode and disc assembly 24. However, the apparatus is operable whether or not the discs of each assembly are offset or in line, except in the latter case perforations in the web are liable to overlap or be irregularly spaced from one another.

The gap 64 between disc electrode rims and moving band electrode edge is adjustable by micrometer screws 65 interconnected by rods 66 with bearing blocks 29 enabling either disc assembly to be raised or lowered as desired. Preferably, gap 64 is adjusted in the range of 0.010 to 0.030 depending upon the power applied to the disc from the high voltage source and the hole size desired in the web to be perforated. Adjustment of the gap to approximately 0.020 is most preferred.

The endless band electrode 25 rotates around the two sheaves 39 and 41 located at each end of slotted rounding plate 62. Opposite segments of band 25 pass within the two slots 63 in plate 62. Installed at regular intervals in the forward and trailing edges of plate 62 are a multiplicity of silver-graphite alloy brushes 67 which penetrate one side of the slot 63 and contact the moving band to insure positive grounding of the band to grounding plate 62 and adequate current load capabilities. Both segments of the band electrode are sufficiently recessed in slots 63 so that the web to be perforated does not come in contact with either segment when passing over the slots. The top of plate 62 is covered with a thin ceramic coating 68 to provide electrical insulation for the plate surface and insure that the electrical discharge from the electrode discs occurs only at the exposed edge of the moving band. The ceramic coating also provides a smooth flat surface for contact with the web as it passes between the disc and band electrodes during perforating.

Figure 6:
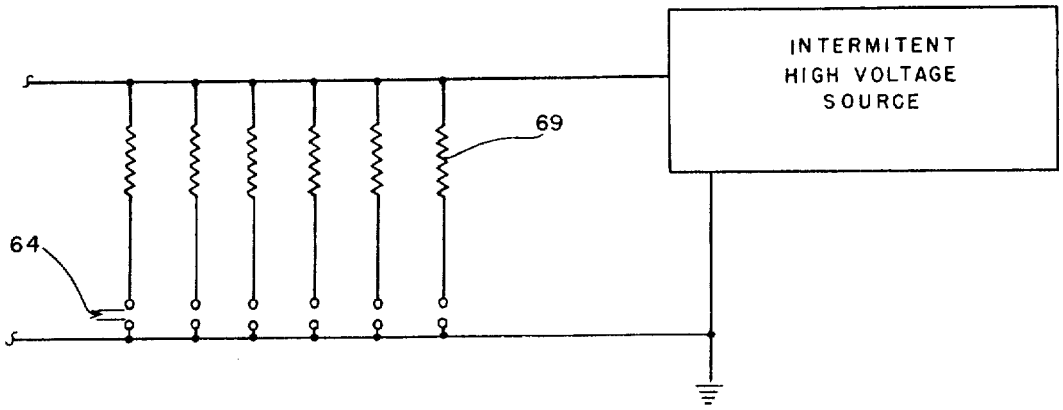
FIG. 6 is a schematic wiring diagram for one set of electrically charged discs connected to the high voltage pulse source.

FIG. 6 schematically illustrates the circuit used to hook up one set of six disc electrodes with the intermittent high voltage power source and grounding of the endless band electrodes. Parallel resistors 69 are incorporated in the circuit in series with each individual disc electrode to couple the voltage source to each disc, thereby providing the current limiting and impedance matching ncessary to insure that all electrodes fire simultaneously across gap 64. In place of resistors, other types of current impedance means may be employed such as capacitors, or coils. Some type of electrical impedance is desirable. Otherwise, as the high voltage pulse rises across the parallel electrodes, the electrode having the closest gap or the least resistance with the ground electrode will attain discharge potential and conduct at maximum current, thereby causing a smaller than adequate voltage drop across the other electrode gaps and preventing their discharge. With series resistive or inductive impedance in the circuit, each disc electrode will receive equal voltage and firing current allowing al electrodes to discharge and conduct or arc essentially simultaneously. A typical high voltage source such as high power pulse generator provides an amplitude of 2.5 to 25 KV, a pulse width of 5 to 300 microseconds at a frequency of 0 to 10 $KH_z$, a current of 50 to 150 milliamps per disc electrode and a resultant duty cycle up to 30%. If a high power pulse generator is used as the high voltage source, the generator will rapidly switch a high voltage current in a pulse conduction sequence, thereby producing the rapid sequential arcing between discharge and ground electrodes for perforating the web. Alternately, the arc control and source may derived from AC generators, DC modulators, or mechanical switching.

Figure 7:
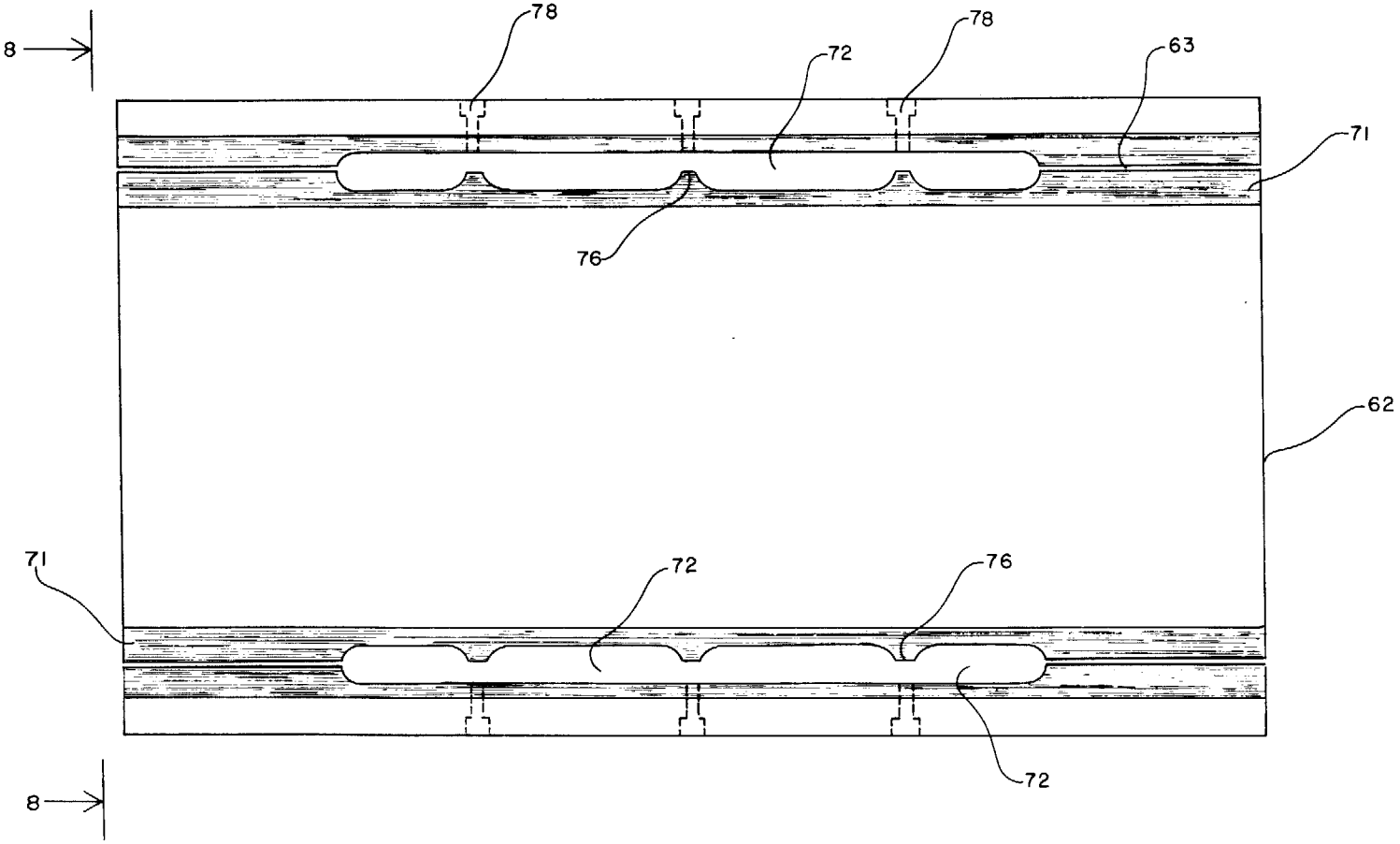
FIG. 7 is a top view of flat plate for supporting the web showing in enlarged detail the recess in the surface adjacent each slot in which the ground electrode travels.
Figure 8:
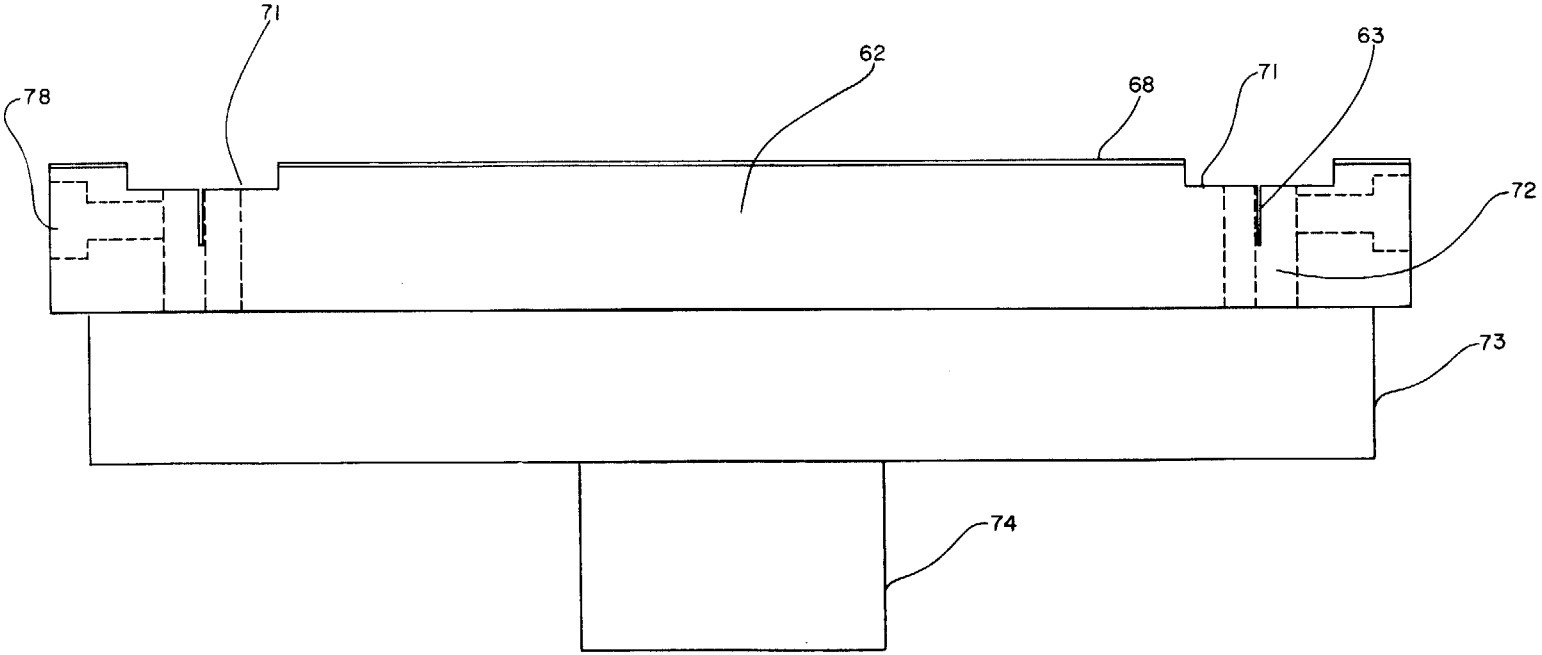
FIG. 8 is an end view of the flat plate as viewed along line 8-8 in FIG. 7.

The improved flat grounding plate 62 of this invention is illustrated in enlarged detail in FIGS. 7 and 8. As shown, recesses 71 in the flat insulated surface 68 of plate 62 are provided along both sides of guide slots 63. Illustratively, the surface 68 is recessed approximately ⅛-inch deep, ½-inch on both sides of slots 63 the entire length of the plate, thereby forming a groove or recess 71 aproximately 1-inch wide centered on the slot 63. Therefore, the paper web moving across the surface 68 during perforating does not contact surface 68 in the immediate vicinity of the moving band electrode. Elongated openings 72 are centrally disposed in the bottom of each recess 71 through the entire thickness of plate 62 and communicate directly with vacuum pan 73 mounted on the bottom side of plate 62. Coupling 74 on the bottom of vacuum pan 73 is connected by a hose to a vaccum source (not shown). Three protrusions 76 are provided along the inner sides of elongated openings 72 in alignment with grounding brushes 67 which pass through and are mounted in holes 78 along opposite sides of plate 62. Protrusions 76 prevent deformation of the grounding band by the spring loaded brushes 67. Accordingly, as shown in the illustrated embodiment, recesses 71 provide a cllection area for particles, grit and other foreign matter produced during the perforating operation, which particulate matter is drawn off as it collects via elongated openings 72 into vacuum pan 73 and thence remmoved to the vacuum source through coupling 74. The resulting continuous removal of particles prevents the buildup thereof on the grounding plate surface enabling the perforating operation to continue without periodic shutdown for cleanup and reduces paper web breaks which tended to occur because of such buildup.

In the illustrated embodiment of the invention, the discharge point between the rotating disc electrodes and endless moving band electrode is, in effect, the knife-like edges of the opposed electrodes. Since the two opposed electrodes move at right angles to one another with only their edges crossing, the arc produced by each pulse from the high voltage source is precisely and narrowly confined. This enables the production of very uniform, minute, evenly spaced perforations in a web such as paper drawn between them.

Figure 9:
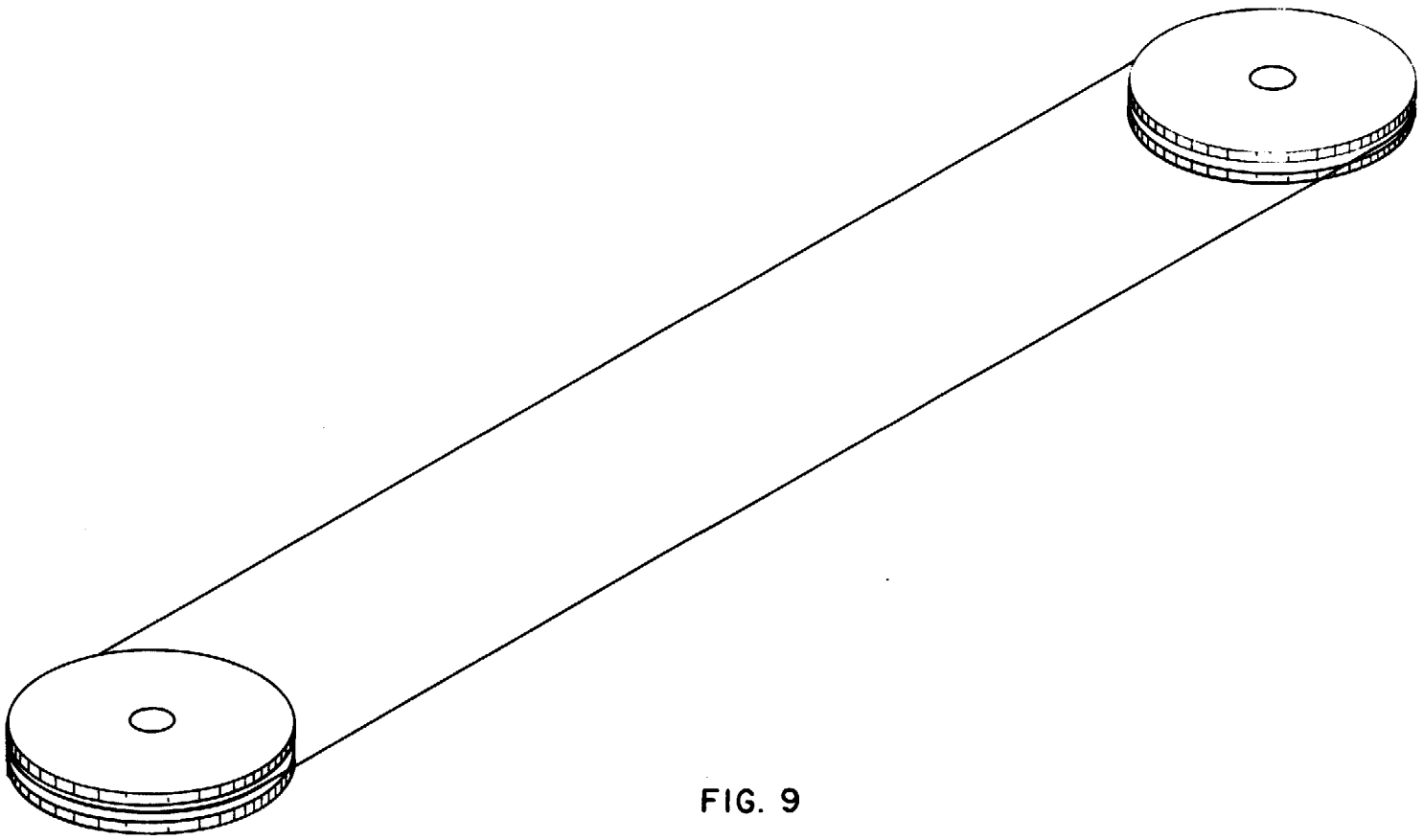
FIG. 9 is a perspective view showing another embodiment of the invention in which the ground electrode is a fine wire disposed in an endless loop.

Furthermore, since both discharge and ground electrode are moving, new discharge surfaces are constantly presented, thereby minimizing thermal erosion of either electrode surface. Of course, while two rotating disc assemblies are illustrated, only one need be used. The advantage of using two disc assemblies enables utilization of both segments of the moving band ground electrode and the concurrent ability to perforate a greater number of holes in the paper when the discs of one assembly are offset from the discs of the other. Any number of discs can be used whether one or two assemblies are used and they can be evenly spaced along the entire length of the assembly or arranged in sets as shown in the drawings, depending upon the degree of perforation and pattern desired. Likewise, the disc assemblies and related apparatus are readily adjustable to accommodate different widths and thicknesses of webs to be perforated. In place of the endless band electrode, a fine wire tautly stretched at right angles to the direction of rotation of the discs can be used as the ground electrode and employed as an endless loop or drawn off a spool from one side of the disc electrode assembly to the other as shown in FIG. 9.

From the foregoing it will thus be apparent that the invention provides a unique method and apparatus for perforating webs of paper, film and the like that was not heretofore available. The preferred embodiments and description are only illustrative and many variatons and modifications may be resorted to without departing rom the spirit and scope of the invention, as those skilled in the art will readily understand.

What is claimed is:

1. Apparatus for perforating a moving web of material by electric discharge comprising:

a. support means;

b. charged circular electrodes comprising a plurality of thin discs of equal diameter rotatably mounted on said support means and aligned axially in spaced relationship to each other, said discs electrically insulated from each other and from said support means;

c. means for rotating said discs on their axis;

d. a narrow ground electrode member mounted on said support means adapted to move at right angles to the direction of rotation of said discs and spaced parallel and in close proximity to the rims of said discs to provide a gap between the rims of said discs and said member;

means for moving said ground electrode member;

f. means for advancing a web through said gap;

g. means for supporting said web as it passes through said gap and for continuously collecting and removing particulate materials produced during perforating comprising a member having a flat surface in contact with said web, a guide slot for said ground electrode, a recess in said surface immediately adjacent said slot, and means for removing particulate materials that collect in said recess; and h. a pulsed high voltage power source connected to each of said discs providing intermittent charges to said discs and concomitant arcs across the gap between said discs and said ground electrode member whereby a moving web of material is perforated as it passes through said gap.

2. The apparatus of claim 1 in which said means for removing the particulate matter from said recess comprises an elongated opening in said recess connected to a vacuum source.

3. The apparatus of claim 1 in which said narrow ground electrode member is an endless loop.

4. The apparatus of claim 1 in which said narrow ground electrode member is a thin band, one edge of which is disposed closer to the rims of said discs than its other edge.

5. The apparatus of claim 1 in which said continuous narrow member is a wire.

6. The apparatus of claim 1 in which said discs are disposed at least two spaced assemblies aligned parallel to one another along the disc centers.

7. The apparatus of claim 6 in which the discs of one assembly are offest axially from the discs of the other assembly.

* * * * *